United States Patent [19]

Hing

[11] Patent Number: 4,797,577

[45] Date of Patent: Jan. 10, 1989

[54] BANDGAP REFERENCE CIRCUIT HAVING HIGHER-ORDER TEMPERATURE COMPENSATION

[75] Inventor: Sam A. Hing, Gland, Switzerland

[73] Assignee: Motorola, Inc., Schaumburg, Ill.

[21] Appl. No.: 133,778

[22] Filed: Dec. 14, 1987

[30] Foreign Application Priority Data

Dec. 29, 1986 [GB] United Kingdom ..... 8630980

[51] Int. Cl.[4] ..... G05F 1/567

[52] U.S. Cl. ..... 307/297; 307/310; 323/281; 323/313; 323/907

[58] Field of Search ..... 323/280–281, 323/273, 907, 313–314; 307/296 R, 297, 310

[56] References Cited

U.S. PATENT DOCUMENTS

| | | | |
|---|---|---|---|
| 4,263,519 | 4/1981 | Schade, Jr. | 307/297 |
| 4,396,883 | 8/1983 | Holloway et al. | 323/281 X |
| 4,443,753 | 4/1984 | McGlinchey | 323/313 |
| 4,524,318 | 6/1985 | Burnham et al. | 323/313 |
| 4,626,770 | 12/1986 | Price, Jr. | 323/313 |
| 4,636,710 | 1/1987 | Stanojevic | 323/281 X |
| 4,714,872 | 12/1987 | Traa | 323/907 X |
| 4,751,463 | 6/1988 | Higgs et al. | 323/281 X |
| 4,763,018 | 8/1988 | Moon | 307/310 X |

OTHER PUBLICATIONS

Chu et al, "A New Dimension to Monolithic Voltage Regulators", IEEE Trans. Broadcast. & Telev. Receivers (U.S.A.) vol. BTR-18, No 2, May 1972, pp. 73–76.

*Primary Examiner*—David Hudspeth
*Attorney, Agent, or Firm*—Michael D. Bingham

[57] ABSTRACT

A bandgap reference circuit is described in which two transistors share a current with their bases coupled together and to an output terminal. A pair of resistors is coupled in series between the emitter of one of the transistors and ground, the emitter of the other transistor being coupled to a node between the resistors. A further transistor is coupled between the output terminal and the node with its base coupled to a second node between two further resistors connected in series between the output terminal and ground. The further transistor and resistors allow the circuit to be compensated for higher order temperature dependence.

5 Claims, 1 Drawing Sheet

BANDGAP REFERENCE CIRCUIT HAVING HIGHER-ORDER TEMPERATURE COMPENSATION

This invention relates to a bandgap reference circuit for providing a reference voltage.

A known bandgap reference circuit comprises first and second transistors, the second of which has an emitter area N times that of the first transistor.

The two transistors are arranged to pass equal currents, the emitter of the second transistor being coupled to ground reference potential through two series connected resistors, whilst the emitter of the first transistor is coupled to the junction of the two resistors.

The bases of the two transistors are coupled together and to an output terminal at which the output reference voltage is provided.

The known circuit provides correction for the linear variation with temperature of the base-emitter voltage of the first transistor by the provision of the second transistor together with the two series connected resistors, the ratio of the values of the two resistors being chosen to correct the first derivative of the base-emitter voltage with respect to temperature.

Unfortunately, with this linear correction, performance with respect to temperature variation of this known bandgap reference is limited. This limitation is due to the fact that variation of a base-emitter voltage is not purely linear with temperature, but has higher order components; in other words, the high order derivatives of this base-emitter voltage are not identically zero.

This invention seeks to provide an improved bandgap reference circuit in which the above problem is mitigated.

According to the invention there is provided a bandgap reference circuit comprising first and second transistors arranged in parallel to share a current, each having a first, second and control electrode, the control electrodes of the transistors being coupled together and to an output terminal; first and second resistors connected in series between the first electrode of the second transistor and a reference potential, the first electrode of the first transistor being coupled to a first node between the resistors; a third transistor having a first electrode coupled to the said first node a second electrode coupled to the output terminal, and a control electrode; third and fourth resistors connected in series between the output terminal and the reference potential, the control electrode of the third transistor being coupled to a second node between the third and fourth resistors.

The first electrodes of the first and second transistors are typically emitter electrodes.

Typically the emitter area of the second transistor is N times that of the first and the emitter area of the third transistor is M times that of the first.

Negative feedback means may be provided for maintaining the output voltage substantially constant.

A starting circuit may be provided for ensuring that the first and second transistors turn on when supply potential is applied to the circuit.

The invention will be further described with reference to the drawings in which.

Figure 1:
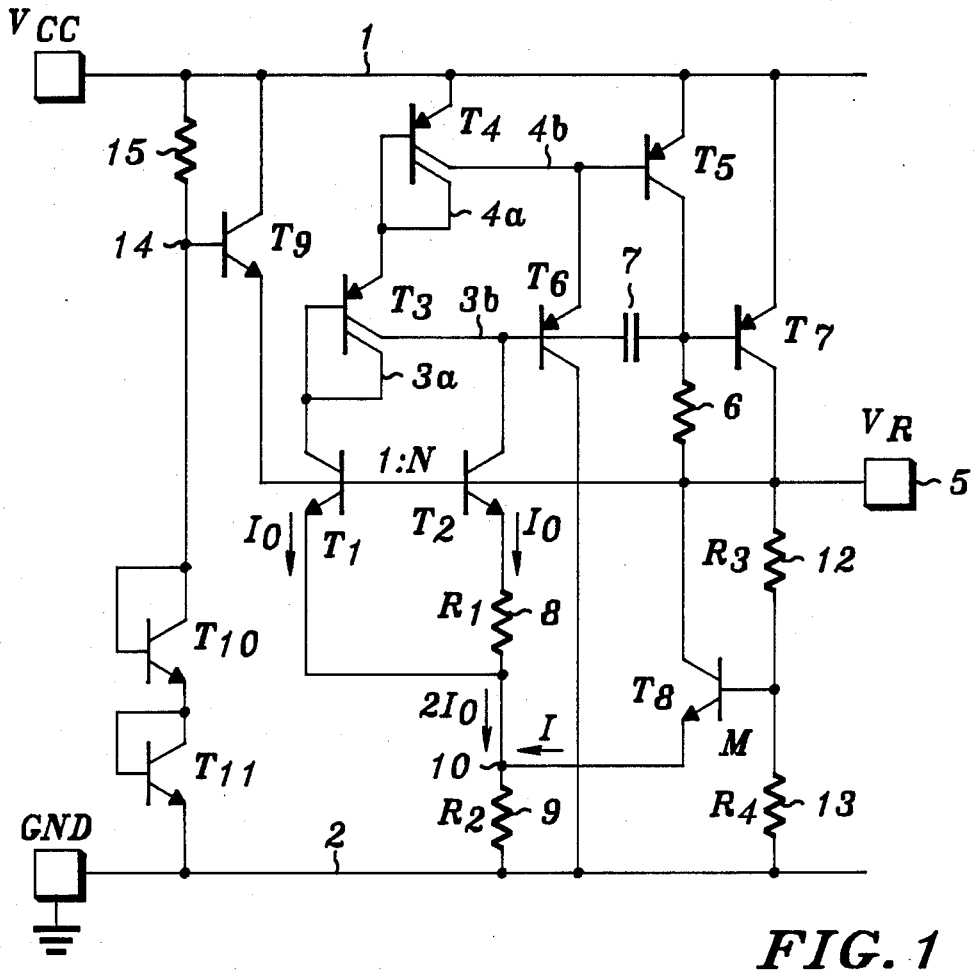
FIG. 1 shows a preferred embodiment of the bandgap reference circuit of the invention.

Referring now to FIG. 1 the illustrated bandgap reference circuit comprises suppl terminals 1 and 2 which in operation are maintained at $V_{cc}$ and for example ground respectively. First and second NPN transistors $T_1$ and $T_2$ whose emitter areas are in the ratio 1 to N are connected in parallel to share equally a single current supplied from the supply terminal.

Current is fed to the transistors $T_1$ and $T_2$ from the supply terminal 1 via two PNP transistors $T_3$ and $T_4$ each having two collectors. The first collector **3*a* of the transistor $T_3$ is connected to the base of the same transistor to form a diode and also to the collector of the transistor $T_1$. The second collector 3*b*** is connected to the collector of the transistor $T_2$. The transistor $T_3$ thus forms a current mirror.

In similar manner the transistor $T_4$ is also wired as a current mirror with first collector **4*a* being connected to the base electrode of transistor $T_4$ to form a diode, and also to the emitter of the transistor $T_3$. The second collector 4*b* of the transistor $T_4$ is connected to the base electrode of a PNP transistor $T_5$ and to the emitter of a PNP transistor $T_6$. The base of the transistor $T_6$ is connected to the collector 3*b* of the transistor $T_3$, whilst the collector of transistor $T_6$ is connected to the ground reference terminal 2**.

The emitter of the transistor $T_5$ is connected to the supply terminal 1 and its collector to the base of a NPN transistor $T_7$ the collector of which is connected to the supply terminal 1 and whose emitter is connected to an output terminal 5.

A resistor 6 has one terminal connected to the base of the transistor $T_7$ and a second terminal connected to the output terminal 5. A capacitor 7 has terminals connected respectively to the bases of the transistors $T_6$ and $T_7$.

The bases of the transistors $T_1$ and $T_2$ are connected together and to the output terminal 5. A pair of resistors 8 and 9 are connected in series between the emitter of the transistor $T_2$ and the ground terminal 2, the emitter of the transistor $T_1$ being connected to a first node 10 between the resistors.

An NPN transistor $T_8$ with an emitter area M times that of the transistor $T_1$ has its emitter connected to the node 10, its collector connected to the output terminal 5 and its base connected to a second node 11 between a pair of resistors 12 and 13 connected in series between the output terminal 5 and the ground terminal 2.

Finally a transistor $T_9$ has its emitter connected to the bases of the transistors $T_1$ and $T_2$ and to the output terminal 5, its collector connected to the supply terminal 1 and its base connected to a third node 14 between a resistor 15 and two series connected transistors $T_{10}$ and $T_{11}$ which are each connected as diodes by the coupling together of their respective bases and collectors. The resistor 15 and the transistors $T_{10}$ and $T_{11}$ form a series connected voltage divider chain between the supply terminal 1 and the ground terminal 2.

In operation and assuming that the supply voltage $V_{cc}$ has been applied and that the transistors $T_1$ and $T_2$ are both conducting, current supplied from the supply terminal 1 will be fed via the collector **4*a* of the transistor $T_4$ and will be assumed to divide equally between the collectors 3*a* and 3*b*** of the transistor $T_3$ so that the transistors $T_1$ and $T_2$ each pass an equal current $I_o$.

The transistors $T_1$ and $T_2$ are matched and a reference voltage $V_R$ will be provided at the output terminal 5 which depends on the base emitter voltage $V_{BE}$ of the transistor $T_1$ and upon temperature due to the variation of $V_{BE}$ with temperature.

As outlined $V_R$ has a dependence upon temperature which has both linear and higher order components. From the analysis which follows it will be seen that by choice of the ratio of the values $R_1$ and $R_2$ of the resistors 8 and 9, the linear temperature dependent component may be compensated, whilst choice of the values $R_3$ and $R_4$ of the resistors 12 and 13 allows compensation of the quadratic dependence.

The provision of the transistor $T_8$, which feeds its emitter current to the node 10, provides an additional degree of freedom to allow compensation of the second order curvature of the curve of reference voltage versus temperature.

The current $I_o$ may be expressed as $$R_1 I_o = V_T \ln N \qquad 1.$$

where $$V_T = kT/q \qquad 2.$$

k is Boltzmann's constnt

T is absolute temperature and q is electronic charge.

Assuming that the resistors $R_1$ and $R_2$, $R_3$ and $R_4$ are matched with a temperature coefficient $\alpha$ at a reference temperature $T_o$, and that the respective values of the above mentioned resistors at $T_o$ are $R_{10}$ and $R_{20}$, $R_{30}$ and $R_{40}$ then;

$$R_1/R_{10} = R_2/R_{20} = R_3/R_{30} = R_4/R_{40} 1 + \alpha T_o (T/T_o - 1) \qquad 3.$$

Assume that the transistors $T_1$, $T_2$ and $T_8$ are also matched with $T_2$ and $T_8$ having above defined emitter areas N and M respectively times that of the transistor $T_1$.

The generalised collector current $I_c$ of the transistor $T_1$ is $$I_c = A\, T^n \exp\left[\frac{V_{BE1}(T) - V_G(T)}{V_T}\right]. \qquad 4$$

where $V_{BE1}(T)$ is the base-emitter voltage of the transistor $T_1$ and n is an exponent, usually between 2 and 3 which depends upon the particular semiconductor process.

$V_G(T)$ is the bandgap voltage which generally depends upon temperature.

A is a constant which depends of process parameters and emitter area.

The voltage $V_{BE1}$ may be expressed as a function of temperature by taking the natural logarithm of the equation 4 as follows:

$$V_{BE1}(T) = \frac{T}{T_o} V_{BE1}(T_o) + V_G(T) - \frac{T}{T_o} V_G(T_o) - V_T\left[(n-1)\ln\frac{T}{T_o} + \ln\left\{1 + \alpha T_o\left(\frac{T}{T_o} - 1\right)\right\}\right]. \qquad 5$$

Now defining the emitter current of the transistor $T_8$ as I, we have $$Y = \frac{I}{I_o} = M \exp - \gamma \frac{V_R}{V_T}. \qquad 6$$

where $$\gamma = \frac{R4}{R_3 + R_4}. \qquad 7$$

The output reference voltage $V_R$ as a function of temperature is given by:

$$V_R(T) = V_{BE1}(T) + \frac{R_2}{R_2}(2 + Y)\, V_T \ln N. \qquad 8$$

To provide the linear and quadratic temperature compensation two parameters $R_2/R_1$ and $\gamma$ need to be chosen as solutions of the system $$\frac{dV_R}{dT} = 0 \text{ and } \frac{d^2V_R}{dT^2} = 0. \qquad 9$$

for $T = T_o$ the chosen reference temperature.

From equations 5 and 8 the solutions are $$\frac{R_2}{R_1}\left[2 + Y_o\left(1 + \ln\frac{M}{Y_o}\right)\right]\ln N = \frac{V_G(T_o) - V_{BE1}(T_o)}{V_{T_o}} - \frac{T_o}{V_{T_o}} \cdot \frac{dV_G}{dT} + n - 1 + \alpha T_o. \qquad 10$$

and;

$$\frac{Y_o\left(\ln\frac{M}{Y_o}\right)^2}{2 + Y_o\left(1 + \ln\frac{M}{Y_o}\right)} = \frac{-\frac{T_o^2}{V_{T_o}} \cdot \frac{d^2V_G}{dT^2} + n - 1 + \alpha T_o(2 - \alpha T_o)}{\left(\frac{V_G(T_o) - V_{BE1}(T_o)}{V_{T_o}}\right) - \frac{T_o}{V_{T_o}} \cdot \frac{dV_G}{dT} + n - 1 + \alpha T_o}. \qquad 11$$

The derivatives of $V_G$ are computed at $T = T_o$ and the value $Y_o$ is obtained from equation 6.

From equation 3

$$\frac{R_2}{R_1} = \frac{R_{20}}{R_{10}} \text{ and } \gamma = \frac{R_4}{R_3 + R_4} = \frac{R_{40}}{R_{30} + R_{40}}$$

at all temperatures.

Thus to complete the calculation of values to obtain both linear and quadratic temperature compensation the value of $Y_o$ is calculated from equation 11 and is used in equation 10 to calculate $R_2/R_1$. The reference voltage $V_R$ can be obtained from the equation 8.

Also using the calculated value of $Y_o$ the ratio $\gamma = R_4/(R_3 + R_4)$ can be obtained from equations 6 and 7 for $T = T_o$.

The equations above and particularly the equations 10 and 11 are general and valid for any flow of bipolar technology.

One problem which arises with bipolar technology is the Early effect which causes the collector current of bipolar transistors to change with variations of the collector-emitter voltage $V_{CE}$ which depends upon fluctuations in the supply voltage.

In application to a bandgap reference, a possible difference between the collector-emitter voltages of transistors $T_1$ and $T_2$ results in a difference in the values of currents flowing in these transistors which were assumed substantially equal. This situation will cause an offset in the values of the output voltage $V_R$ which will depend upon these fluctuations in the supply voltage. In terms of supply voltage rejections, this situation will cause performance deterioration if a process exhibits poor Early effect properties.

In the circuit of FIG. 1, due to the particular arrangement of transistors $T_3$, $T_4$, $T_5$ and $T_6$, the collector-emitter voltages of transistors $T_1$ and $T_2$ are substantially kept equal. Thus, the collector currents of these transistors will be substantially equal. This equality is always true, whatever the fluctuations of the supply voltage.

Moreover, an offset also may occur due to the current gains of bipolar transistors which are generally limited. The circuit of the invention corrects this limitation.

Negative feedback means is provided to maintain the output voltage $V_R$ constant. Indeed if $V_R$ decreases (or increases) the current through $T_2$ becomes larger (or smaller) than that through $T_1$. By virtue of the action of the current mirror formed by the transistor $T_3$, the difference of these currents will appear as base current of the transistor $T_6$. This base current is increased (or decreased) and forces the transistors $T_5$ and $T_7$ to conduct more (or less) so that, the output voltage $V_R$ is forced to be increasing (or decreasing).

When the circuit is first turned 'on', the reference voltage $V_R$ will be at about zero volts. To ensure that the transistors $T_1$ and $T_2$ turn on to establish the proper reference voltage, a starting circuit is provided by the transistor $T_9$ which is biased by the potential at node 14 of the potential divider chain formed by resistor 15 and the two diode connected transistors $T_{10}$ and $T_{11}$ When $V_{cc}$ is applied and the voltage at the node 14 rises more than one base-emitter voltage, the transistor $T_9$ will conduct, causing the voltage at the bases of the transistors $T_1$ and $T_2$ to rise, so tht $T_1$ and $T_2$ turn 'on'. $V_R$ will then rise to its proper value.

In view of the diode connected transistors $T_{10}$ and $T_{11}$ the node 14 cannot rise to a voltage more than $2V_{BE}$ of the transistors $T_{10}$ and $T_{11}$ above ground potential. Since $V_R$ generally is approximately equal to this $2V_{BE}$ value, the transistor $T_9$ will turn off when $V_R$ rises to a sufficient value to annul bias its base-emitter junction. The starting circuit then becomes inoperative.

Figure 2:
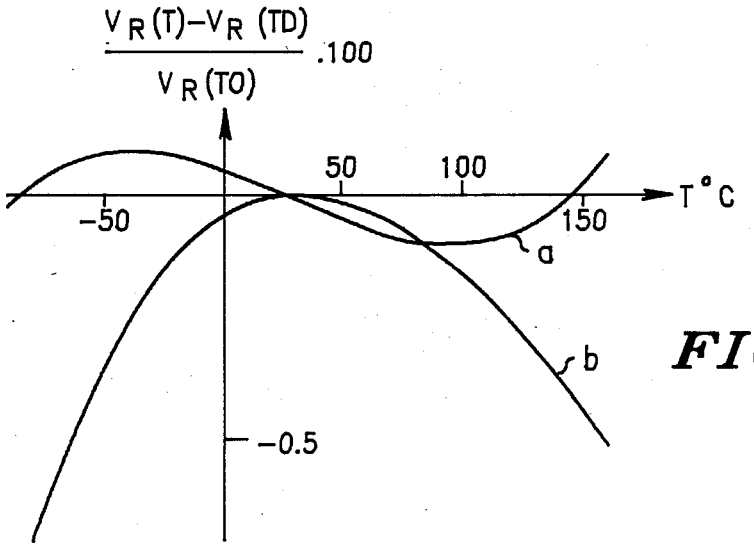
FIG. 2 shows graphs of the variation of reference voltage with temperature for the prior art circuit and for the circuit of FIG. 1.

Referring now to FIG. 2 there is shown in curve a, a graph of the variation of the reference voltage with temperature for the circuit of this invention and at curve b the same graph plotted for a prior art bandgap reference circuit. The curves are self explanatory and clearly indicate the advantage of the circuit of the invention in providing quadratic law temperature correction which is not evident in the prior art circuit.

The invention has been described by way of example and modification may be made within the scope of the invention for example the negative feedback loop formed by the transistors $T_6$, $T_4$, $T_5$, $T_7$ resistor 6 and capacitor 7 may be simplified by omitting the transistors $T_4$, $T_6$ and $T_5$, resistor 6 and capacitor 7 and correcting the emitter of the transistor $T_3$ directly to the supply terminal 1 and the collector **3*b*** directly to the base of the transistor $T_7$ and inverting the collectors of the transistors $T_1$ and $T_2$.

Alternatively if the particular bipolar technology exhibits good Early effect properties, the negative feedback circuit may be omitted altogether and the emitter of the transistor $T_3$ connected directly to the supply terminal 1.

I claim:

1. A bandgap reference circuit comprising first and second transistors coupled in parallel to share a current, each having a first, second and control electrode, the control electrodes of the transistors being coupled together and to an output terminal; first and second resistors connected in series between the first electrode of the second transistor and a reference potential, the first electrode of the first transistor being coupled to a first node between the resistors; a third transistor having an emitter coupled to said first node, a second electrode coupled to the output terminal, and a control electrode; third and fourth resistors connected in series between the output terminal and the reference potential, the control electrode of the third transistor being coupled to a second node between the third and fourth resistors.

2. The circuit of claim 1 wherein the first electrodes are emitter electrodes.

3. The circuit of claim 2 wherein the emitter area of the second transistor is N times that of the first and the emitter area of the third transistor is M times that of the first.

4. The circuit of claim 3 wherein negative feedback means is coupled for maintaining the output voltage substantially constant.

5. The circuit of claim 4 wherein a starting circuit is coupled for ensuring that the first and second transistors turn on when supply potential is applied to the circuit.

* * * * *